US005232127A

United States Patent [19]

Trotta et al.

[11] Patent Number: 5,232,127

[45] Date of Patent: Aug. 3, 1993

[54] ACTUATOR AND HOOD FOR DISPENSING DEVICE

[75] Inventors: Robert A. Trotta, Pembroke; Brian A. Rogers, South Boston; Stephen C. Metcalf, West Newton, all of Mass.

[73] Assignee: The Gillette Company, Boston, Mass.

[21] Appl. No.: 785,041

[22] Filed: Oct. 30, 1991

[51] Int. Cl.[5] ..... B67D 1/16

[52] U.S. Cl. ..... 222/108; 222/402.13; 222/562; 222/635

[58] Field of Search ..... 222/108, 190, 402.1, 222/402.13, 562, 635; 239/337, 340, 573

[56] References Cited

U.S. PATENT DOCUMENTS

| | | | |
|---|---|---|---|
| 3,305,179 | 2/1967 | Lehmann | 239/337 |
| 3,312,723 | 4/1967 | Anderson et al. | 222/402.13 |
| 3,318,488 | 5/1967 | Barnes | 222/182 |
| 3,628,702 | 12/1971 | Kimura | 222/402.13 |
| 4,132,333 | 1/1979 | Debard | 222/402.13 |
| 4,978,035 | 12/1990 | Morane et al. | 222/108 |
| 5,027,982 | 7/1991 | Demarest | 222/402.13 X |

FOREIGN PATENT DOCUMENTS

| | | | |
|---|---|---|---|
| 973848 | 9/1975 | Canada | 222/402.13 |
| 2633899 | 2/1977 | Fed. Rep. of Germany | 239/337 |
| 2394466 | 2/1979 | France | 222/402.13 |
| 1057353 | 2/1967 | United Kingdom | 222/402.13 |
| 8300134 | 1/1983 | World Int. Prop. O. | 239/337 |

*Primary Examiner*—Andres Kashnikow
*Assistant Examiner*—Joseph A. Kaufman
*Attorney, Agent, or Firm*—Owen J. Meegan; Aubrey C. Brine; Donal B. Tobin

[57] ABSTRACT

A dispenser device for a foam producing gel includes an actuator and a hood, the actuator being mounted at the top of a gel container and having an inlet contacting the valve stem of the gel container and a nozzle having an outlet directed radially outwardly from the top of the container. The hood is open at the bottom and engages the outer surface of the actuator to cover the actuator when not in use. An opening is provided in the hood and a notch in the rim of the opening contacts a detent on the outer surface of the actuator to ensure that the hood opening is opposite the nozzle outlet of the actuator when the hood is in place. The hood opening when so positioned serves to inhibit excess foaming of gel remaining between the actuator inlet and nozzle outlet when the hood is in place after usage, and a notch is formed in the nozzle structure below the actuator outlet to provide a path of flow downwardly from the outlet as foamed product expands outwardly from the outlet.

8 Claims, 3 Drawing Sheets

ACTUATOR AND HOOD FOR DISPENSING DEVICE

BACKGROUND OF THE INVENTION

The present invention is directed to apparatus for dispensing a foaming product contained in a pressurized container and more particularly to an actuator and hood for such dispensing device.

A great many products may be found on the market which provide a shaving foam dispensed from a pressurized container of the type having a valve which includes a valve operating stem extending from the container top the stem having a free end which is moveable downwardly to release pressurized material through an opening in the valve stem. In general, these containers are provided with a hand operated actuator and a cap or hood which sealingly engages the top of the container, covering the actuator, when the shaving product is stored and not in use.

Typical of such apparatus are the devices disclosed in U.S. Pat. No. 3,312,723 issued to J. J. Anderson et al on Apr. 4, 1967, U.S. Pat. No. 3,305,179 issued to H. G. Lehmann on Feb. 21, 1967, U.S. Pat. No. 3,318,488 issued to C. O. Barnes on May 9, 1967, and U.S. Pat. No. 4,978,035 issued to Morane et al on Dec. 18, 1990.

In addition to those shaving materials which produce a foam product directly at the nozzle of the dispenser, it is also known to provide a gel substance as a shaving material, the substance being formed as a gel as it is dispensed, but producing a foam when applied to the skin of the user.

It has been found that when employing a foaming product of the type described above, in combination with the prior art dispensing apparatus, in many instances after the cap has been placed over the actuator device the material that remains in the conduit between the valve in the container and the nozzle outlet has a tendency to continue the production of a foam, forcing material from the outlet of the nozzle and creating a quantity of foam material between the nozzle and the hood or cap, which creates an unsightly blob of material, when the cap is removed. The foamed material over a period of time generally extends from the nozzle to the inner surface of the cap or hood, at which point it contacts the surface, remains moist, and due to a lack of a drying environment, continues to foam spreading along the inner surface of the hood which is sealingly engaged to the container.

It is therefore an object of the present invention to provide apparatus for dispensing a foaming product contained in a pressurized container which substantially decreases the amount of foam produced at the outlet nozzle of apparatus when the apparatus is not is use.

A further object of the invention is to provide dispensing apparatus of the type described which substantially promotes the rapid drying of material produced at the outlet nozzle of the apparatus, when not in use.

Another object of the invention is to provide apparatus for dispensing a foaming product which comprises an actuator and hood combination which is simple to manufacturer and effective to minimize the foaming of product at the actuator outlet when the dispensing apparatus is not in use.

SUMMARY OF THE INVENTION

The above objects and other objectives which will become apparent as the description proceeds are accomplished by providing apparatus for dispensing a foaming product contained in a pressurized container of the type having a valve which includes a valve operating stem extending from the container top and having free end, the valve stem being moveable downward to release pressurized material through an opening in the valve stem. The apparatus generally includes an actuator having a first portion which comprises means for attachment of the actuator to the container top and a second portion which comprises a conduit for dispensing the product from the operating stem the conduit having an outlet at one end thereof and wall structure defining an inlet opening for receiving a portion of the operating stem. The wall structure has an inwardly projecting surface for engaging the free end of the valve stem and the actuator further includes an elongated nozzle which extends outwardly from the center of the container and terminates in a substantially planar surface in which the outlet is formed. An outwardly extending flange is disposed about the periphery thereof and the flange terminates below and to either side of the outlet to form a notch in the flange such that foam product is provided a path to flow downwardly from the surface, as the foam product gradually expands outwardly from outlet.

The actuator further may comprise an upwardly facing bearing surface upon which the user presses to initiate the dispensing operation and the first and second portions of the actuator may be connected by a resilient hinge member.

The apparatus generally includes a hood formed of wall structure comprising a closed top, open bottom and side wall, the open bottom having a rim for engaging the outer surface of the actuator attachment means. The hood side wall has an opening formed therein opposite the nozzle surface which is sized to allow the foam product to vent uninhibited as the foam product gradually expands outwardly from the outlet, and means disposed on the outer surface of the actuator attachment means is provided for engagement with the hood side wall to insure location of the hood opening opposite the nozzle surface with the hood engaged to the actuator attachment means.

BRIEF DESCRIPTION OF THE DRAWING

The foregoing and other features of the invention will be more particularly described in connection with the preferred embodiment, and with reference to the accompanying drawing wherein.

DESCRIPTION OF THE PREFERRED EMBODIMENTS

Figure 1:
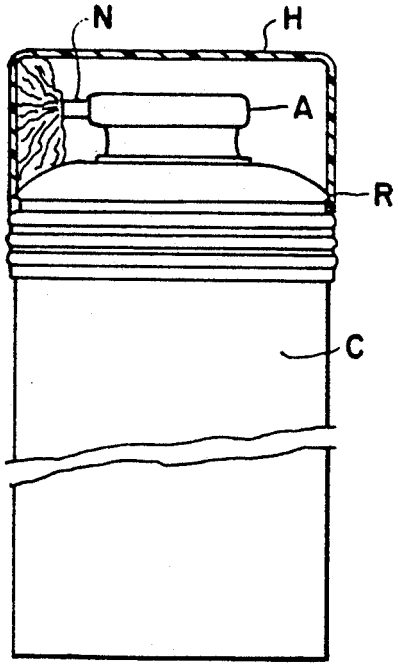
Fig. 1 PRIOR ART
FIG. 1 is a left side elevational view showing a prior art dispenser comprising an actuator and hood or cap.

Referring now to the drawing, and in particular to FIG. 1, there is shown apparatus of the prior art for dispensing a foaming product contained in a pressurized container C of the type alluded to above, having a valve stem extending from the container top terminating in a free end which is interconnected to an actuator A having a nozzle N with an outlet opening through which the material, whether a directly produced foam or gel, is dispensed. The dispensing apparatus further comprises a cap or hood H which is sealingly engaged to the container C at its rim R when the product is not being used.

As depicted in FIG. 1, after a period of time material contained in the nozzle end, and which has gas bubbles entrained therein, is forced from the nozzle N and forms a blob of material extending from the nozzle N to the inner surface of the hood H. When the hood H is removed, the user is confronted with an unsightly lump of material which may build up within the hood H if not removed prior to each use of the dispensing apparatus.

Figure 2:
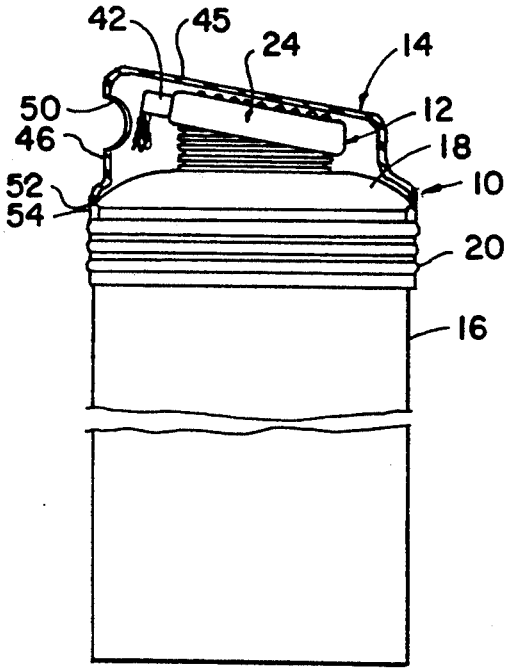
FIG. 2 a left side elevational view similar to FIG. 1 showing a dispenser device having an actuator and hood constructed in accordance with the teachings of the present invention.
Figure 3:
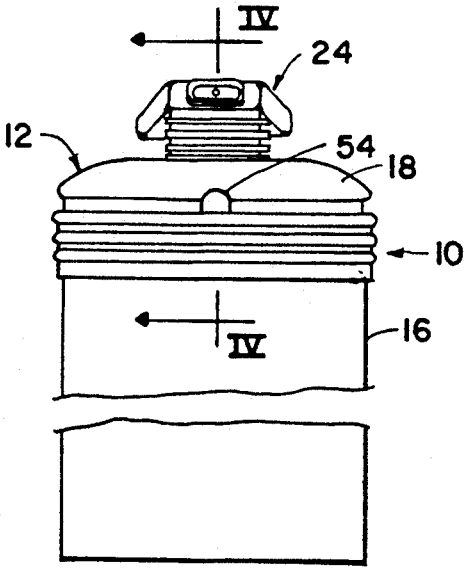
FIG. 3 is a front elevational view showing the actuator of FIG. 2.

Referring now to FIGS. 2 through 6 there is shown the dispensing apparatus 10 constructed in accordance with the teaching of the present invention. The dispensing apparatus 10 comprises an actuator 12 and a hood 14, the hood being removeable during usage of the dispensing device as shown in FIG. 3, and serving to cover the actuator 12 by being sealingly engaged to the structure forming the actuator 12 as shown in FIG. 2. The dispensing apparatus 10 is mounted on a pressurized container 16 of the type having a valve including a valve operating stem extending from the container top upwardly and having a free end which is moveable downwardly to release pressurized material, which in the present embodiment is in the form of a foaming gel, through an opening in the free end of the valve stem. Such containers are well known in the art and therefore will not be further described with respect to the present invention.

Figure 4:
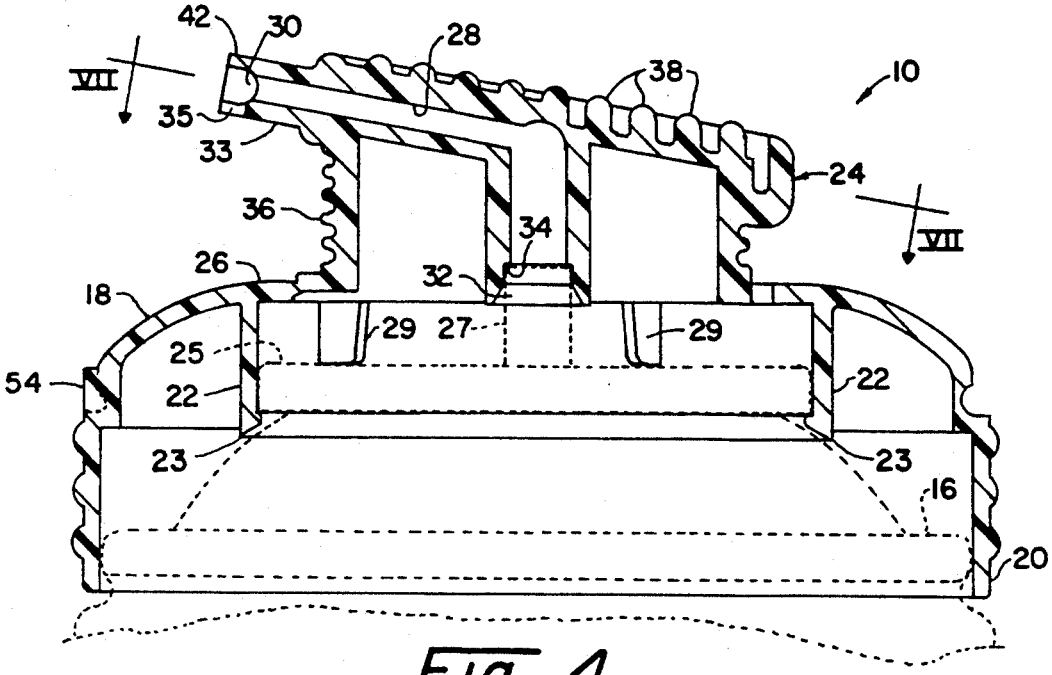
FIG. 4 is a sectional view taken along the lines IV—IV of FIG. 3, showing the actuator of FIGS. 2 and 3 on an enlarged scale for clarity.

As best shown in FIG. 4, the actuator 12 comprises a first portion 18 having an outer cylindrical wall 20 and an inner cylindrical wall 22 having a lip 23 and extending downwardly into the opening provided by the outer cylindrical wall 20. The actuator portion 18 is constructed such that the inner cylindrical wall 22 may be force fit over a valve crimp 25 formed at the top of the pressurized container 16 with the lip 23 under the valve crimp and the upwardly extending valve 27 engaged in a second actuator portion 24 as will be explained in detail below. The actuator portion 18 when assembled to the container 16 is prevented from being forced downwardly to a position which would activate the valve 27 by virtue of four downwardly extending flanges 29 (only two shown) contacting the valve crimp 25. The actuator portion 24 is freely moveable relative to the actuator portion 18 by virtue of a resilient hinge 26 formed between the two actuator portions 18 and 24.

Figure 5:
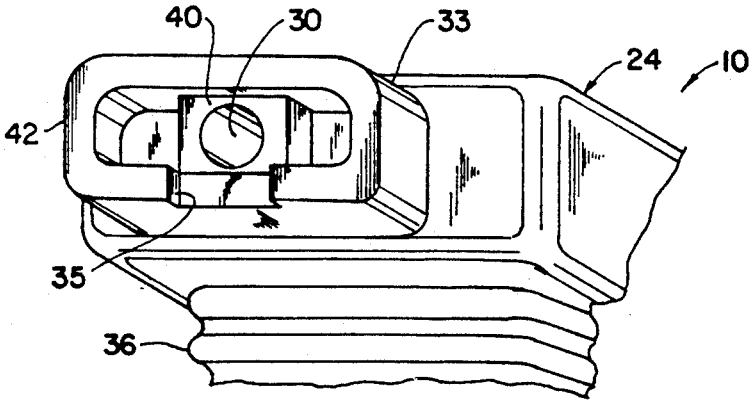
FIG. 5 is a left front perspective view showing details of a portion of the actuator of FIGS. 2 through 4 taken on an enlarged scale to better define the structure.
Figure 7:
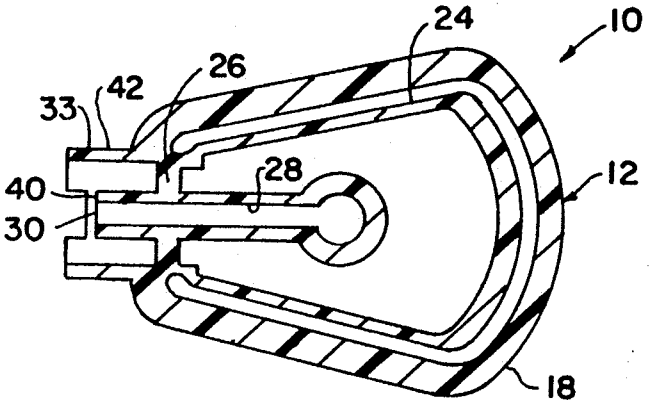
FIG. 7 sectional view taken along the lines VII—VII of FIG. 4 showing additional details of the actuator of FIGS. 2 through 5.

Referring to FIGS. 4 and 5, the actuator portion 24 has formed therein a conduit 28 having an outlet opening 30 at one end thereof and wall structure defining an inlet opening 32 for receiving a portion of the valve stem. The wall structure has an inwardly projecting surface 34 for engaging the end of the valve stem without forcing the valve stem downwardly when the actuator portion 18 is fixed to the pressurized container 16 as described above.

The vertical walls 36 of the actuator portion 24 are substantially rigid and the upper surface of the actuator portion has a plurality of laterally extending ribs 38 to provide a surface by which the user may force the actuator portion 24 downwardly, rotating about the hinge 26, to force the valve stem down and release material into the conduit 28.

As best shown in FIGS. 3, 4 and 5, the outlet 30 terminates in a nozzle portion 33 of the actuator 12 which has an outwardly extending flange disposed about the outlet. The outlet 30 is set inwardly of the edge of the flange 42 and formed in a planar surface 40. The surface 40 and flange 42 form the nozzle portion 33 for dispensing the foaming gel material. As best shown in FIGS. 4 and 5, the flange 42 terminates below and to either side of the outlet opening 30 creating a notch 35 which substantially provides a continuation of the surface 40 and allows material forced from the outlet opening 30 to gradually move down the surface without being retained within the nozzle, as best shown in FIG. 2.

Figure 6:
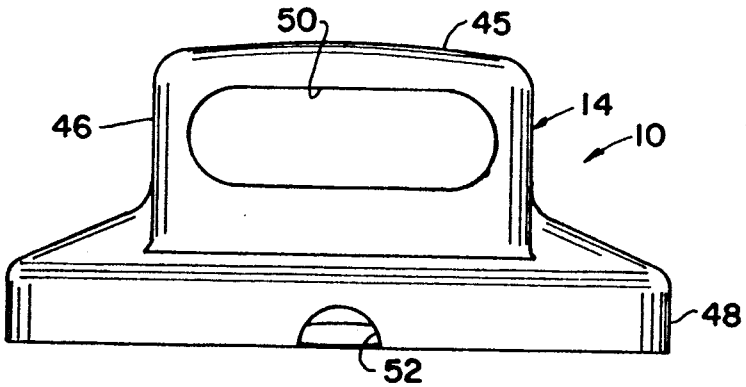
FIG. 6 is a front elevational view showing details of the hood of FIG. 2.

Referring to FIGS. 2 and 6, the hood 14 is cylindrical in form and shown to comprise a closed top wall 45, side wall 46 and an open bottom formed by a rim 48. An elongated opening 50 is formed in the side wall 46 and sized to allow the gas initially entrained in the foam product to vent uninhibited from the hood 14 when the hood is placed over the actuator. It has been found that the opening 50 is best utilized when located adjacent the planar surface 40 containing the outlet opening 30, as explained below, and to insure the proper orientation of the opening 50 the rim 48 has a notch 52 which engages a detent 54 when the hood is so located.

The combination of actuator 12 and hood 14 described above substantially inhibits the formation of the blob of foam material formed between the actuator and hood in prior art devices by allowing gas initially entrained in the foamed product to vent uninhibited through the hood opening as the product gradually expands outwardly from the outlet during storage of the container 16 after usage. The opening 50 also allows for the flow of drying air into the hood 14 which promotes a rapid drying of the material produced at the outlet 30 of the nozzle 33 which tends to minimize the volume of material foamed. Additionally, the location of the opening 50 opposite the outlet 30, should foaming produce a material build-up toward the inner wall of the hood, the material retains a surface area open to drying air by not contacting the hood.

It is also considered that by providing an extension of the surface 40 such that the material which may form at the opening 30 is allowed to drop from the surface due to gravity rather than remain within the nozzle area where it would continue foaming due to a limited exposure to drying air further eliminates the buildup of material found in prior art gel dispensing apparatus.

While it is apparent that changes and modifications may be made within the spirit and scope of the present invention it is our intention, however, only to be limited by the appended claims.

As our invention we claim:

1. Apparatus for dispensing a foaming product contained in a pressurized container of the type having a valve including a valve operating stem extending from the container top and having a free end, said valve stem being moveable downwardly to release pressurized material through an opening therein, said apparatus including an actuator having a first portion comprising means for attachment to the container top and a second portion comprising a conduit for dispensing the product from the operating stem and having an outlet at one end thereof and wall structure defining an inlet opening for receiving a portion of the operating stem, said wall structure having an inwardly projecting surface for engaging the free end of the valve stem, said actuator further including an elongated nozzle extending outwardly from the center line of the container and terminating in a substantially planar surface in which said outlet is formed, and an outwardly extending flange formed on said planar surface for substantially surrounding said opening and terminating below and to either side of said outlet to form a notch in said flange whereby foamed product is provided a path to flow downwardly along said planar surface as said foamed product expands outwardly from said outlet.

2. The apparatus of claim 1 wherein said actuator second portion further comprises an upwardly facing bearing surface on which a user presses to initiate the dispensing operation.

3. The apparatus of claim 1 wherein said actuator first and second portions are interconnected by a resilient hinge member.

4. The apparatus of claim 1 which further includes a hood formed of wall structure comprising a closed top, open bottom and side wall, the open bottom having a rim for engaging the outer surface of said actuator attachment means, and the whole of said hood side wall being spaced from said nozzle and having an opening formed therein opposite said nozzle outlet and sized to allow the foamed product to vent uninhibited as the foamed product gradually expands outwardly from said outlet.

5. The apparatus of claim 4 which further includes means disposed on said outer surface of said actuator attachment means for engagement with said hood side wall to ensure location of said hood opening opposite said nozzle surface with said hood sealingly engaged to said actuator attachment means.

6. The apparatus of claim 4 wherein said actuator second portion further comprises an upwardly facing bearing surface on which a user presses to initiate the dispensing operation.

7. The apparatus of claim 6 wherein said actuator first and second portions are interconnected by a resilient hinge member.

8. The apparatus of claim 7 which further includes means disposed on said outer surface of said actuator attachment means for engagement with said hood side wall to ensure location of said hood opening opposite said nozzle surface with said hood sealingly engaged to said actuator attachment means.

* * * * *